United States Patent [19]

Mackie et al.

[11] 4,059,979

[45] Nov. 29, 1977

[54] MEANS FOR FLARING OPENINGS IN CYLINDRICAL BODIES

[75] Inventors: Gordon E. Mackie, Utica; Peter A. Morris, Jackson, both of Miss.

[73] Assignee: Allis-Chalmers Corporation, Milwaukee, Wis.

[21] Appl. No.: 698,831

[22] Filed: June 23, 1976

[51] Int. Cl.[2] ..... B21D 51/40

[52] U.S. Cl. ..... 72/342; 29/157 T

[58] Field of Search ..... 72/342; 113/116 UT; 29/157 T

[56] References Cited

U.S. PATENT DOCUMENTS

| | | | |
|---|---|---|---|
| 1,574,900 | 3/1926 | Kellogg | 72/342 |
| 2,511,836 | 6/1950 | Cullen | 29/157 T |
| 3,910,094 | 10/1975 | Luttgert et al. | 72/342 |

*Primary Examiner*—Lowell A. Larson

*Attorney, Agent, or Firm*—Robert C. Jones

[57] ABSTRACT

A stationary pulling unit with a movable workpiece provides for an on center locating point under the operating unit for coupling a flaring tool to the stationary pulling unit and heating the area to be flared with torches in a heat cycle and in a pulling cycle as the flaring tool is pulled through the opening in the workpiece.

3 Claims, 6 Drawing Figures

IV
IV

MEANS FOR FLARING OPENINGS IN CYLINDRICAL BODIES

BACKGROUND OF THE INVENTION

The present invention relates to a method and apparatus for flaring openings in cylindrical metallic bodies of relatively heavy gauge material which are to be utilized as sealed enclosures for gas insulated circuit breakers.

Presently known means for effecting the flaring of openings in metallic bodies are either a cold working procedure or a semi-hot working procedure. In the cold working procedure, flaring is accomplished by pulling a plurality of graduated dies, one at a time, through the opening to gradually enlarge the opening to a desired size. This procedure is time consuming and costly. If flaring of the opening is not accomplished, the opening would have to be cut into the tank and the operator tank to be subsequently fitted to the opening will require special forming to provide a saddle to mate with the contour of the enclosure tank. This is not acceptable in a power breaker enclosure for dielectric reason which requires a construction wherein all sharp corners are eliminated.

In the semi-hot working procedure, heat is not applied so that it follows the contour of the body being worked. As a result, grain growth and cold spots are experienced with cracking of the material around the flare developing. In either case, the cracks must be welded and the weld ground so that a smooth surface is obtained. This procedure is also time consuming and costly.

SUMMARY OF THE INVENTION

A method is herein disclosed for flaring the edge of an opening formed in a cylindrical workpiece which includes the improvement of inserting a flaring tool within the cylindrical workpiece, heating the area of the cylindrical workpiece adjacent to the opening to be flared to a plastic state and pulling the flaring tool through the opening to flare the edge thereof.

Apparatus is also disclosed for practicing the method and includes a stationary frame defining a work station. A flaring tool in the work station is engageable in the opening formed in the cylindrical workpiece by operation of a ram which is supported for vertical movement into and out of coupled engagement with the flaring tool. Power means is provided to effect a coupling of the ram with the flaring tool and thereafter to move the ram to draw the flaring tool through the opening thereby forming a flared collar portion around the opening.

The workpiece is moved into the work station locating the opening to be flared in centered relationship with respect to the axis of the pulling unit. Clamping means holds the workpiece in centered position within the work station. Heating torches are moved in toward the workpiece and moved in a path of travel following the contour of the cylindrical tank workpiece. This action provides for heating a relatively large area of the tank around the opening to be flared. Heating by operation of the torches is continued as the flaring operation is accomplished. For the flaring operation the die of the size required is moved into the cylindrical workpiece in a position in axial alignment with the ram of the pulling unit. The ram is advanced to engage with the die and then retracted to bring the die into operation.

An object of the present invention is to provide a method and apparatus for flaring an opening in a metallic cylindrical body in a single pass.

Another object of the present invention is to provide a method and apparatus for heating the contour of the cylindrical body around the entire area in which the flaring is to be accomplished.

Still another object of the present invention is to provide a method and apparatus for heating the area of the cylindrical body in which the opening to be flared is located while flaring is being accomplished.

A still further object of the present invention is to provide a stationary pulling unit for flaring openings in a movable workpiece.

Yet another object of the present invention invention is to provide torch means which automatically follows the contour of the metallic body in which flaring is to be accomplished.

A further object of the present invention is to provide torch means which are made to cycle in a heat operation and also in a pulling or flaring operation.

DESCRIPTION OF THE INVENTION

Figure 1:
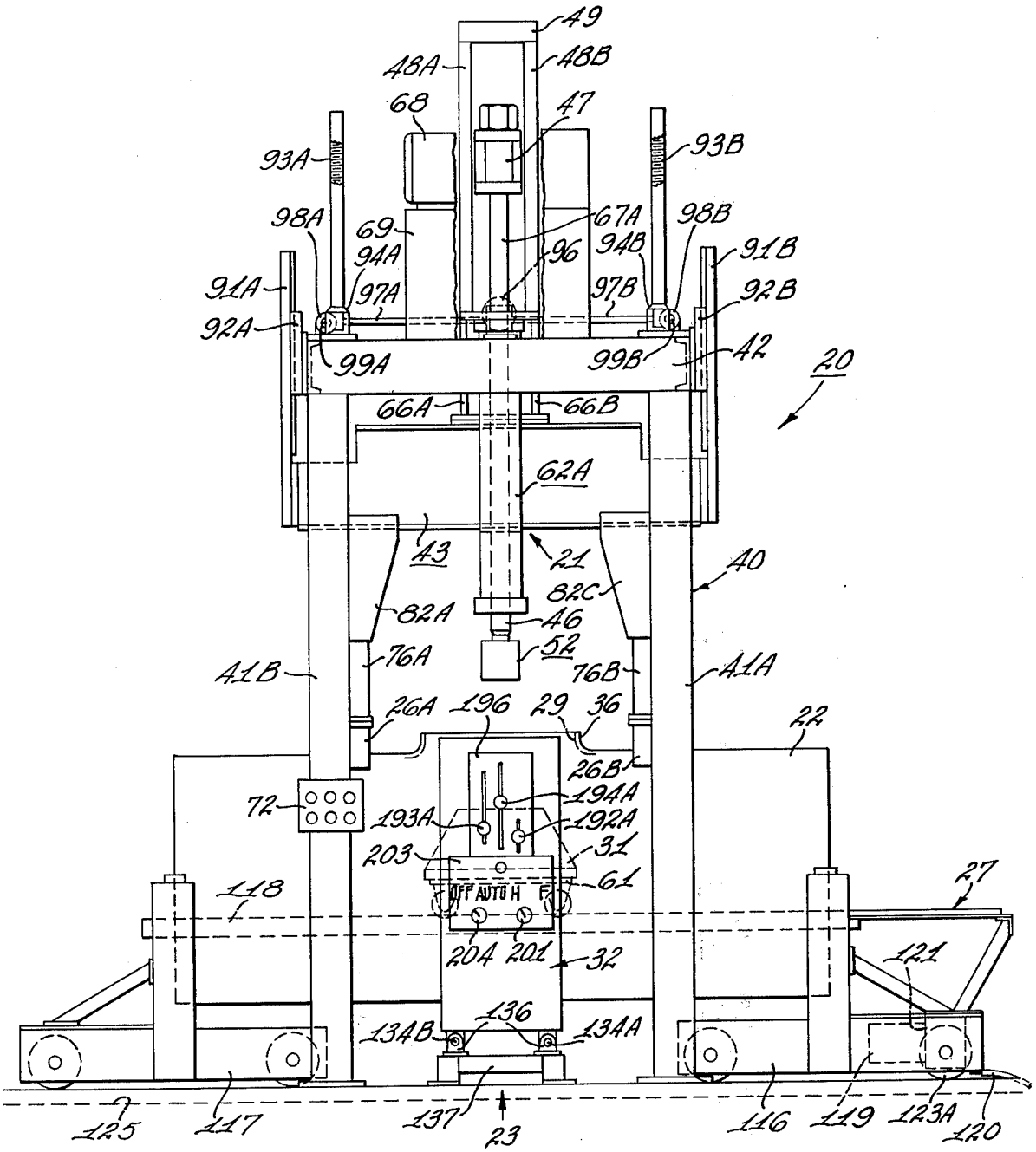
FIG. 1 is a view in front elevation of the flaring apparatus.
Figure 2:
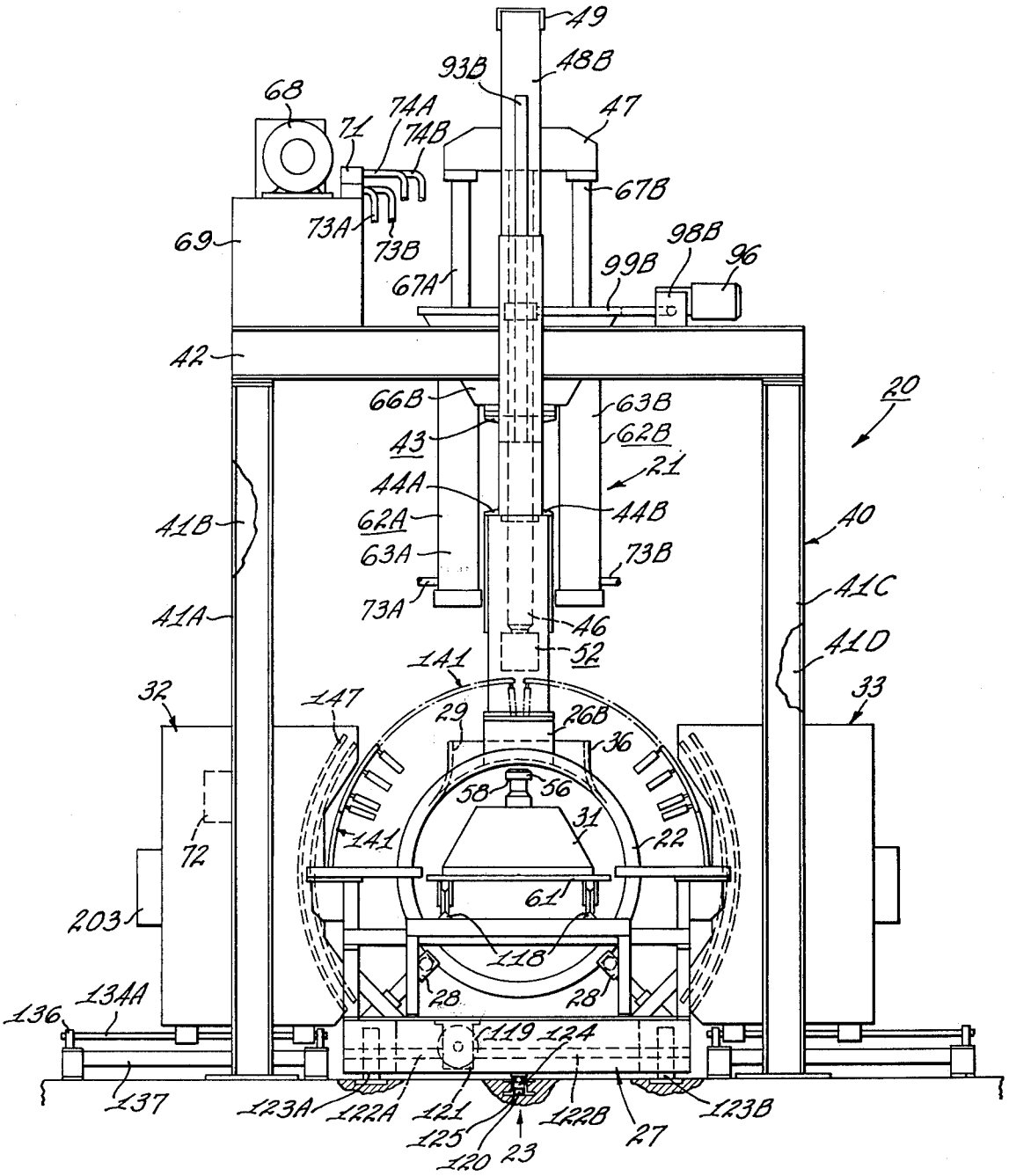
FIG. 2 is a view in elevation as seen from the right in FIG. 1.

As shown in FIGS. 1 and 2, there is depicted a flaring apparatus 20 comprising a pulling unit 21 which is located in a fixed position relative to a workpiece 22, herein depicted as a cylindrical tank, which is movable into and out of a work station 23. The pulling unit 21 includes clamp means 26 and 26A which operate to engage the workpiece 22 to effectively exert a clamping force on the tank 22 to lock it in position and against the pulling force of the pulling unit 21.

The cylindrical tank workpiece 22 is supported on a carrier means 27 which is movable into and out of the work station 23. Incorporated with the carrier means 27 are means 28, FIG. 2, which operate to support the cylindrical workpiece 22 on the carrier means 27 and also to provide for rotational adjustment of the tank about its own axis to center an opening, such as indicated at 29, which is to be flared with the axis of the pulling unit 21.

A flaring tool or die 31 is provided and is insertable into the cylindrical workpiece 22 for centering under the pulling unit 21 in position to enable the pulling unit 21 to couple thereto.

Prior to the pulling unit 21 coupling to the flaring tool, heating torch units 32 and 33 are moved inwardly toward the cylindrical workpiece into position to apply heat to the workpiece from substantially a horizontal plane radially upwardly toward the top of the workpiece. With the area of the cylindrical tank heated to a desired degree, the pulling unit 21 is caused to advance to couple to the flaring tool and thereafter retract bringing the flaring tool 31 into engagement with the edge of the opening. The continuous pull of the pulling unit pulls the frusto-conical flaring tool into the opening forcing the edge of the opening to roll upwardly forming a circular opening of a desired diameter which also includes an outwardly extending circular collar portion 36.

The operation produces a flared opening which exhibits no cracks or unevenness and the opening formed can be up to a ratio of 1:.9 with diameter of the tank. The smoothness of the material around the flared opening, especially in the area where the collar portion 36 deviates from the main body of the tank, in the tanks that are used in gas insulated circuit breakers, is of extreme importance. This is true because any rough edges or seams can result in electric failure. Cracks around the opening will result in loss of the insulating gas which is relatively expensive but a more serious result can be a failure of the circuit breaker.

The flaring method herein set forth produces an opening having a collar 36 which is circular in configuration. Thus, an operator tank portion (not shown) which will be welded in abutting relationship to the collar edge can be of standard commercially available pipe cut to desired lengths.

Figures 3, 4:
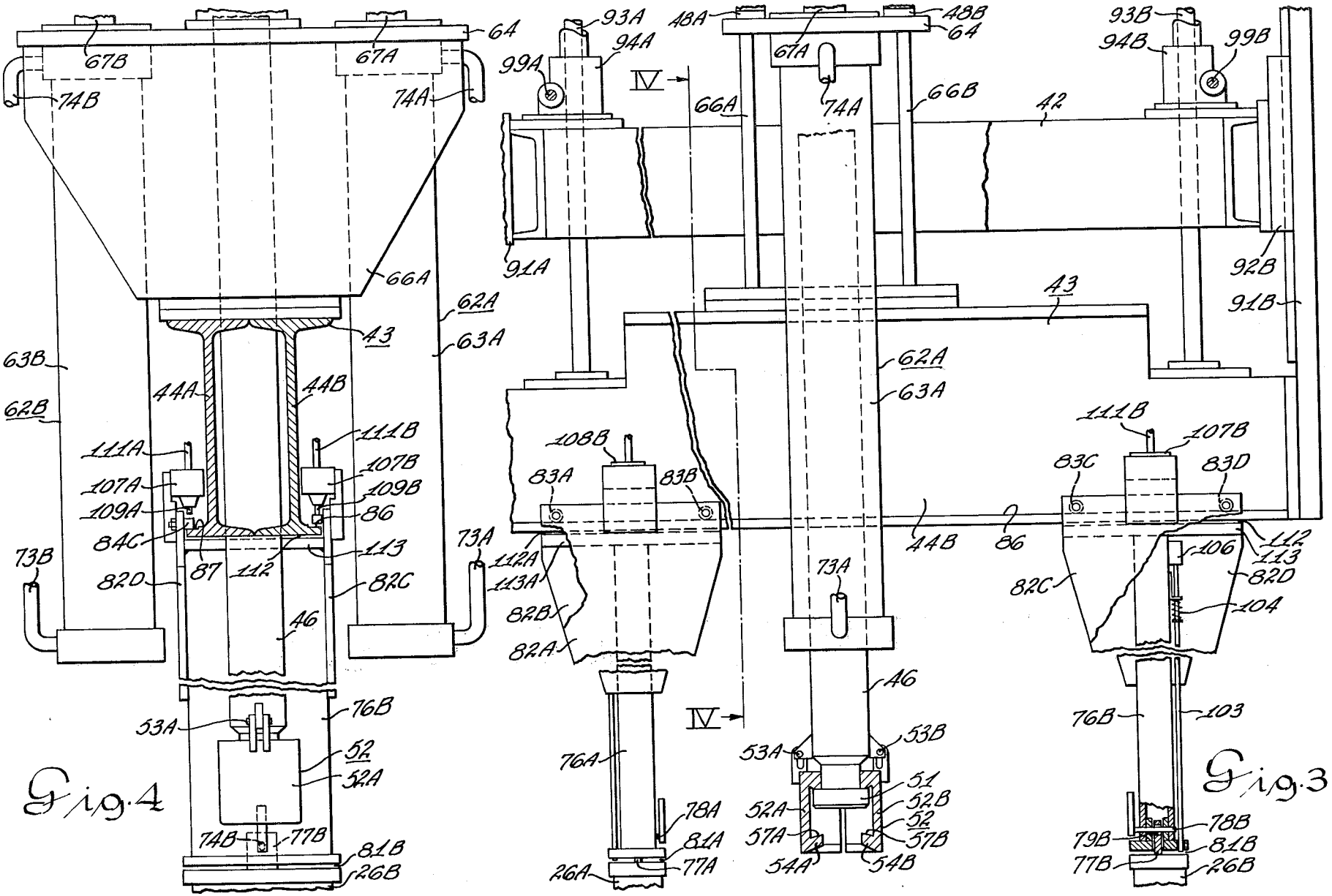
FIG. 3 is an enlarged fragmentary view partly in elevation and partly in section showing details of the cross beam and ram structure therein.
FIG. 4 is an enlarged fragmentary side view taken in a plane represented by the line IV—IV in FIG. 3.

As previously mentioned, the pulling unit 21 is supported on a rigid supporting frame 40 and defines the work station 23. Frame 40 comprises four rigid pillars 41A, 41B, 41C and 41D. A girder box frame 42 is bolted or otherwise secured to the upper ends of the pillars 41A, 41B, 41C, 41D to complete the support 40. As shown in FIG. 1, the pulling unit 21 is carried on a vertical movable beam member 43 which includes a pair of I-beams 44A and 44B. Extending between the I-beams 44A and 44B is an elongated ram 46. The upper end of the ram 46 is secured in a yoke 47 which is guidably constrained between upright guides 48A and 48B tied together by a cap 49. The lower end of the ram 46 is provided with a mushroom head portion 51 as shown in FIG. 3 on which a split collet 52 is located. Each portion of the split collet 52 is pivotally hinged as at 53A and 53B to radially outwardly extending ears which are welded to the ram 46. The lower ends of the collet portions are each provided with semi-circular inwardly extending finger portions 54A and 54B, respectively. As shown in FIG. 3, the undersurface of the finger portions 54A and 54B are sloped upwardly to provide a ramp for receiving and coupling to the head portion 56 of the flaring tool 31. The upper inner surfaces 57A and 57B of the finger portions 54A and 54B are formed with a locking angle complementary to a locking angle formed on the undersurface 58 of the flaring tool head portion 56. Thus, as the ram 46 is lowered into coupling engagement with the flaring tool 31 the collet portions 52A and 52B pivot outwardly allowing the head 56 of the tool to slide into the interior of the collet. As the ram retracts upwardly, the collet portions 52A and 52B pivot inwardly, by the force of gravity, into locking engagement with the tool head 56. A release of the tool may be effected by downward movement of the ram to lower the flaring tool 31 to a supporting surface such as is provided by a tool carriage 61 and manually open the collet to release the tool. The carriage 61 may then be moved to remove the tool 31 from under the ram and the ram is free for retraction to the parked noninterfering position that it occupies as depicted in FIGS. 1 and 2.

Movement of the ram 46 in either of its directions of movement is effected by means of a pair of fluid actuators 62A and 62B which herein are shown as piston and cylinder mechanisms. The cylinders 63A and 63B, as shown in FIG. 3, depend from a support plate 64 carried on a pair of spaced apart side plates 66A and 66B that are welded to or otherwise secured to the top of the beam 43. The free ends 67A and 67B of the piston rods associated with the cylinders 63A and 63B, respectively, are secured in the extending ends of the vertically movable yoke 47.

For effecting the operation of the fluid actuators 62A and 62B for moving the ram, a fluid pump 68 is provided. As shown in FIGS. 1 and 2, the pump 68 is mounted on a reservoir 69 and draws the hydraulic fluid from the reservoir and delivers it under pressure to the cylinders 63A and 63B. Such distribution of fluid under pressure is controlled by a solenoid operated valve 71 which is connected to the lower ends of the cylinders 63A and 63B by flexible conduits 73A and 73B, respectively. Solenoid valve 71 is also connected to the upper ends of the cylinders by flexible conduits 74A and 74B, respectively. Operation of the solenoid valve 71 in a selected mode to effect the lowering or raising of the ram 46 is accomplished in a well known manner by selective operation of an appropriate selector switch in a control box 72 which is located on the pillar 41B.

Clamping of the workpiece such as the cylindrical tank 22 in position in the work station 23 is accomplished by the pair of clamp members 26A and 26B. The clamp members 26A and 26B are configured to have an arcuated surface which is complementary to the curved surface of the cylindrical tank 22. The clamps 26A and 26B are carried on the depending ends of a pair of posts 76A and 76B. As shown in FIGS. 3 and 4, the clamp members or shoes 26A and 26B are attached to the ends of their associated posts 76A and 76B, respectively, by means of tongues 77A and 77B, respectively. The tongues 77A and 77B insert in openings formed in the ends of the posts 76A and 76B and are secured therein by means of rods 78A and 78B. As exemplified by the tongue 77B associated with the clamp shoe 26B, the opening in the tongue through which the pin 78B extends is formed as a slot 79B. Thus, spaces 81A and 81B are provided between the lower ends of the posts 76A and 76B and the clamp shoes 26A and 26B. These spaces allow the clamp shoes 26A and 26B to be lowered, by movement of the beam 43, to engage with and equalize on the workpiece cylindrical tank prior to a full clamping force being exerted.

The workpiece clamps are positionable along the beam 43 to accommodate for various diameters of flare openings. To this end, the upper ends of the clamp shoe posts 76A and 76B are secured to vertical plates 82A, 82B, 82C and 82D, respectively. Thus, the post 76A is secured between a pair of plates 82A and 82B, while the post 76B is secured between plates 82C and 82D. For effecting position movement of the clamps on the beam 43, the plates 82, as exemplified by the plates 82C and 82D in FIG. 4, are provided with sets of rollers 83 and 84. Thus, the sets of rollers 83 associated with the plate 82C engage on a roller surface 86 formed on the flange of the I-beam 44B of beam 43. In a similar manner, the sets of rollers 84 associated with the plate 82D are adapted to ride on a roller surface 87 formed on the flange of the I-beam 44A of horizontal beam 43. A similar arrangement is provided for the rollers associated with the plates 82A and 82B. Thus, both of the clamp members 26A and 26B may be moved to a desired position on the vertically movable support beam 43 to accommodate different diameters of flare openings.

For moving the clamp shoes 26A and 26B into and out of clamping engagement with the cylindrical tank workpiece 22, the beam 43 is supported for vertical movement. To this end, the ends of the beam 43 are provided with guides 91A and 91B which engage in slideways 92A and 92B that are secured to the top of the frame 20. Extending upwardly from the ends of the beam 43 are a pair of gear rack members 93A and 93B. The rack members pass through and mesh with gearing contained within gear reduction units 94A and 94B in a well-known manner. The gear reduction units 94A and 94B are driven simultaneously by means of an electric motor 96. To this end, a pair of horizontal laterally extending drive shafts 97A and 97B are operatively connected to be driven by the motor 96. Each of the drive shafts 97A and 97B are connected by associated angle drive mechanisms 98A and 98B to shafts 99A and 99B which are connected as input shafts to the gear reduction units 94A and 94B, respectively.

Selectively, actuation of a control switch on the control panel 72 will effect the operation of the motor 96 in a direction to cause the beam 43 to be moved downwardly. Downward movement of the beam 43 will effect engagement of the clamp shoes 26A and 26B with the workpiece 22. With clamping of the workpiece effected, the space 81A and 81B will be closed. As this occurs, a rod 103 operatively carried alongside of the post 76B, as shown in FIG. 3, is actuated upwardly. This is true because the rod 103 is biased downwardly by means of a spring 104 and as the clamp shoe 26B engages with the workpiece 22, the shoe 26B becomes relatively stationary while post 76B continues to move downwardly an additional slight distance. As a result, the portion of the clamp shoe 26B adjacent to the lower end of the post 76B engages the depending end of the rod 103 moving it upwardly against the pressure of the spring 104. When full clamping of the workpiece has been achieved, the rod 103 will have been moved a distance sufficient to actuate a limit switch 106 and thereby deenergize the electric motor 96 stopping the downward movement of the beam 43.

Prior to effecting the engagement of the clamp shoes 26A and 26B with the workpiece the plates 82A and 82B, and 82C and 82D which movably support the posts 76A and 76B respectively, must be clamped to the beam 43. This is true because a rigid or metal-to-metal relationship between the posts 76A and 76B with the rail 43 must be established, eliminating the clearance space 112 between bottom plates 113 and 113A. To this purpose a switch on the control panel 72 is actuated to effect operation of sets of post clamps 107 and 108. A exemplified by the clamp sets 107, shown in FIGS. 3 and 4, the clamp 107A is mounted on a bracket which is bolted to the plate 82D. In a similar manner, the clamp 107B is carried on a bracket which is secured to the plate 82C. Each of the clamps is provided with rams 109A and 109B which are arranged to engage the roller surfaces 87 and 86 of the I-beam members 44A and 44B. The rams 109A and 109B are actuated into clamping engagement with the associated I-beam members 44A and 44B by fluid under pressure supplied to the interior of the actuator housings via conduits 111A and 111B, respectively. Thus, with the clamp shoe posts 76A and 76B positioned along the beam 43 to locate the clamp shoes 26A and 26B in a desired position relative to the workpiece 22, the clamps 107A and 107B are actuated to lock the posts in position on the beam. Actuation of the clamps 107A and 107B is accomplished by selective actuation of a switch on the control panel 72. By returning the switch to an "off" position, the rams 109A and 109B are automatically released by spring pressure in a well-known manner.

With the clamps 107A and 107B actuated, the clearance spaces 112 and 112A between the bottom plates 113 and 113A and the bottom of the rail 43, which is provided to permit free movement of the clamp posts 76A and 76B on the I-beams 44A and 44B, is eliminated to provide for a solid connection between the bottom surfaces of the I-beam members 44A and 44B and the adjacent end face surface of the post 76A. This is true because positioning and clamping of the post members 76A and 76B is effected prior to the engagement of the clamp shoes 26A and 26B with the workpiece 22.

As previously mentioned, the cylindrical tank workpiece 22 is movable into and out of the work station 23 on a carriage means 27. The carriage means 27 includes a pair of carriers 116 and 117 coupled together in spaced apart relationship by a tool fixture trackway 118. Each carrier 116 and 117 mounts workpiece fixtures for holding and clamping the workpiece on the carriers. Movement of the carriers as a unit into and out of the work station 23 is effected by an electric motor 119 which is supported by a suitable bracket from the undersurface of the carrier 116. The motor 119 drives through a gear box 121 to oppositely extending drive shafts 122A and 122B. Drive shafts 122A and 122B are connected by coupling means (not shown) to the shafts of support wheels 123A and 123B of carrier 116. Since carriers 116 and 117 are coupled together by the tool fixture track 118, they move as a unit and the drive from the wheels 123A and 123B is sufficient to effect such movement. Power for the electric motor 119 is obtained from an electric cable 120 which extends within a guideway 125 in the floor from a take-up reel (not shown). For maintaining the workpiece carriage 27 in a straight-line path of travel a guide roller 124 on each of the carriers 116 and 117, the guide roller 124 associated with the carrier 116 being shown in FIG. 2, extends within the guideway 125.

The flaring or forming tool 31 is moved into and out of the work station 23 below the ram 46 on the tool carrier 61. As shown, the carrier 61 is provided with V-grooved wheels that cooperate with the V-configured tracks 118. In the particular arrangement shown, the tool carrier 61 is moved into and out of work position manually, but such operation could be accomplished automatically with power means if desired.

Figure 5:
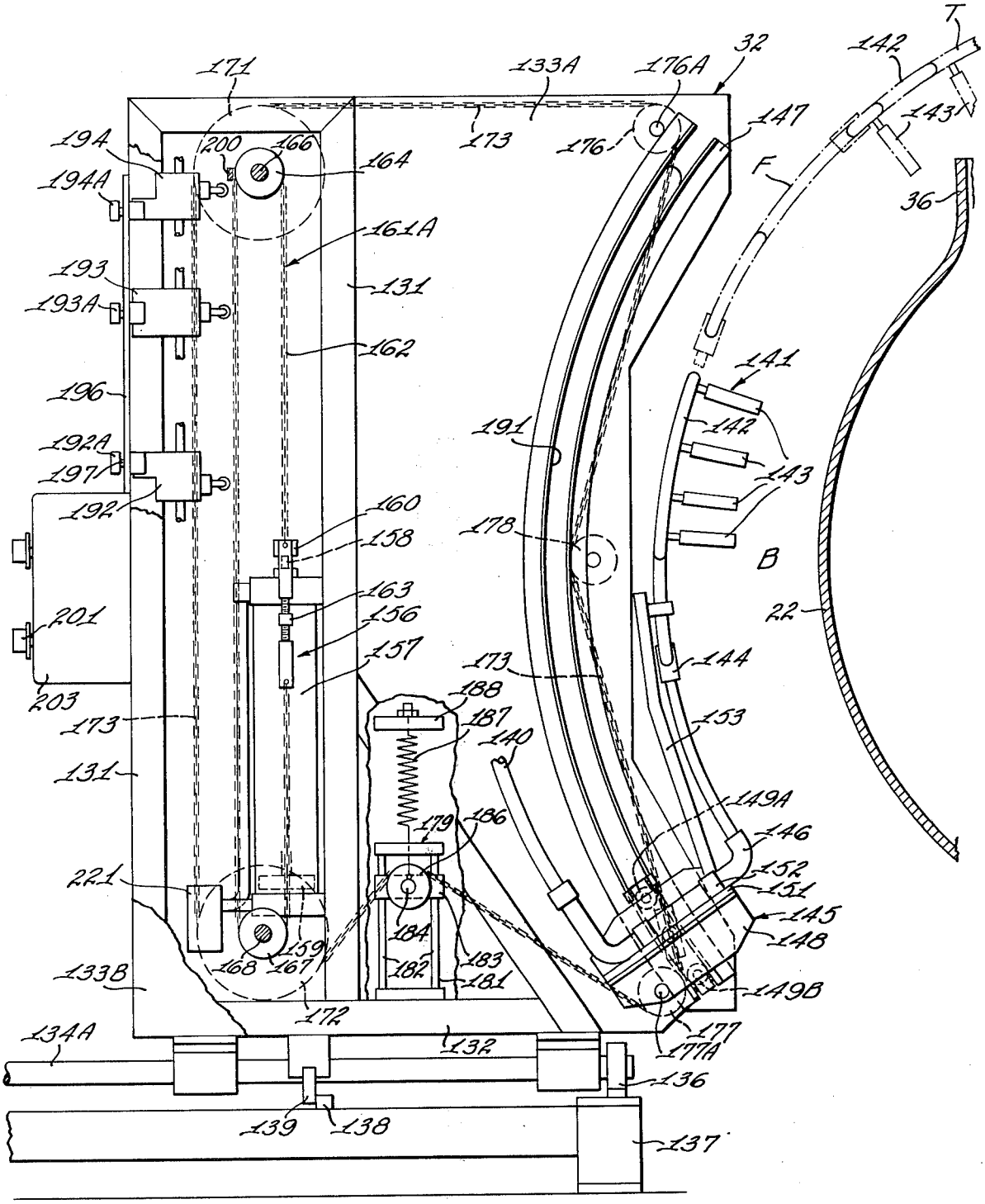
FIG. 5 is an enlarged view partly in right side elevation and partly in section of a torch unit; and, FIG. 6 is a schematic view of the control for operating the torch unit.

As previously mentioned, the area of the cylindrical tank 22 around the area of the opening to be flared is heated to substantially 1000° C prior to the flaring tool 31 being drawn through the opening. To this end, torch units 32 and 33 are provided; the units are substantially the same and the description of unit 32 will also apply to the torch unit 33. As shown in FIG. 5, torch unit 32 includes an upright frame 131 having a base 132. Side plates 133A and 133B reinforce the upright frame 131 and serves as supports for mechanisms to be described. The unit 32 is supported for movement toward and away from the workpiece on a pair of guide rails 134A and 134B, which, in turn, carried on brackets 136 that are secured to a base 137. A positive stop 138 on the base 137 is engageable by a dog 139 which depends from the base of the torch unit 32 to establish the maximum forward position of the unit. A torch head or flame head 141 is carried for movement by the unit 32 so as to follow an arcuate path of travel which is substantially parallel to the contour of the cylindrical tank. The torch head 141 is substantially semicircular so that with the torch head at the limit of uppermost travel, the ends of the torch head are on either side of the opening to be flared. The torch head includes a semicircular tubular body 142 in which a plurality of positionable nozzles 143 are arranged. A gas distributor 144 receives and holds the tubular body 142 at a fixed distance from the cylindrical workpiece 22. A supply of gas from a source (not shown) is supplied to the tubular body 142 of the torch head 141 via a flexible conduit 140 which is connected to a rigid conduit 146 that, in turn, communicates with the distributor 144.

As mentioned, the torch head 141 is movable in an arcuate path relative to the contour of the cylindrical tank 22. To this end, a movable torch support 145 is provided and is carried for movement by the side plates 133A and 133B. As shown in FIG. 5, the side plates 133A and 133B are provided with identical arcuate guideways, the guideway 147 associated with the side plate 133A being shown. A plate 148 is provided with a pair of spaced apart follower rollers 149A and 149B which are mounted on the side of the plate adjacent to the guideway 147. These rollers are adapted to track in the guideway 147. A similar plate (not shown) with associated tracking rollers is provided for tracking in the guideway associated with the side plate 133B. Extending between the two plates 133A and 133B is a spacer member 151 that operates to maintain the plates 133A and 133B in spaced apart relationship and also as a base for supporting the torch head 141. As shown, the torch head 141 is secured to the spacer 151 by brackets 152 which hold the torch head 141 in the desired operating position. A bracket 153 extends upwardly from the spacer 151 and is coupled to the tubular pipe of the torch head 141 to provide a stabilizing support for the head 141. Thus, as the torch support 145 moves upwardly tracking in the arcuate guideways, the torch head 141 is made to follow a path of travel which is parallel to the contour of the cylindrical tank 22. As a result, the torch head 141 from its bottom position, which position it occupies as depicted in FIG. 5, will move upwardly to a top position "T" wherein the ends of the semicircular torch head 141 will be in a position just short of a vertical plane that passes through the longitudinal axis of the cylindrical tank 22. This movement of the torch head 141 is accomplished to heat the metal area of the tank adjacent to the opening to be flared to a plastic condition which it obtains when the metal is approximately 1000° C. With heating accomplished, the stroke of the torch head 141 is reduced so that it moves between the bottom position and a flare position indicated by the phantom outline "F" of the torch head 141. At this position, the tool ram structure as it moves downwardly to engage with the flaring tool 31 will not be interfered with. Also the heating of the metallic area is continued as the flaring tool 31 is drawn upwardly to effect a flaring of the opening. The heating and the heating during the flaring operation of the metallic area around the opening results in a flared collar portion 36 being formed which exhibits smooth contours and which is free of cracks. This result obtained is extremely important in cylindrical tanks which are intended as enclosures for gas-insulated circuit breakers.

Movement of the torch head carrying plates 148 is effected by a fluid actuation means 156 including a cylinder which is secured to a member of the frame 131. The actuator includes a piston 159 and a piston rod 158 the free end of which is connected to a crossbar 160 which extends between chain drives. The chains are identical and are associated with gearing carried by the side plates 133A and 133B. In FIG. 5, the chain drive 161A associated with the side plate 133A and the torch support plate 148 is depicted and a description of the drive 161A will also apply to the complementary drive arrangement associated with the side plate 133B. As shown, the chain 162 has one end attached to the arm of the crossbar 160 which extends toward the side plate 133A. The opposite end of the chain 162 is attached to a take-up device 163 which is adjustable to maintain the proper tension in the chain 162. The take-up device 163, in turn, is also attached to the extending arm of the crossbar 160. Thus, operation of the fluid actuator to extend the piston rod 158 will effect the movement of the chain in a counterclockwise direction, as viewed in FIG. 5. The chain 162 is entrained over an upper sprocket gear 164 which is secured to drive a shaft 166 and a lower sprocket gear 167 which is secured to drive a shaft 168. Both of the shafts 166 and 168 are journalled in and extend through their associated side plates 133A and 133B. Mounted on the end of the shaft 166 that extends through the side plate 133A is a larger sprocket gear 171 which is free riding or idling the shaft 166. A similar sprocket gear 172 is mounted on the extending ends of shaft 168 to be driven thereby. Entrained over the sprocket gears 171 and 172 is a torch head drive chain 173 which travels over upper and lower idler pulleys 176 and 177 that are journalled on stub shafts 176A and 177A. An intermediate pulley 178 journalled on the outside of the plate 133A serves to maintain the forward run of the chain in a noninterfering position. To maintain the torch head chain 173 under proper tension, a take-up arrangement 179 for the chain is provided. As depicted, the take-up 179 includes a guide bracket 181 having a pair of spaced apart rods 182. Slidable on the rods 182 is a slide bar 183 in which a stub shaft 184 is mounted. The stub shaft 184 extends beyond the rods 182 and the free end thereof rotatably supports an idler pulley 186 over which the chain 173 travels. A spring 187 has one end attached to the slide bar 183 and its opposite end attached to a bracket 188. Thus, a constant yieldable force is applied to the chain 173 to maintain proper tension on the chain.

In order to effect movement of the torch head carrier 145, the transversely extending spacer bar 151 has its ends adapted to extend through arcuate slots 191 in the side plates which are located between the guideway tracks. In FIG. 5, the slot 191 associated with the guideway 147 on the side plate 133A is shown. With this arrangement, the chain 173 is attached to the extending end of the spacer bar 151. Thus, the fluid actuator 156 operating in a direction to effect counterclockwise movement of the chain 162 will cause the drive chain 173 to be moved in a counterclockwise direction. As the drive chain 173 moves counterclockwise, it, in turn, effects upward movement of the torch support 145 to thereby move the torch head 141 upwardly. Conversely clockwise movement of the chains will effect downward movement of the torch head 141.

Control of the movement of the torch head 141 is accomplished by controlling the fluid actuator 156. To this end, a plurality of valves 192, 193 and 194 are provided. The valve 192 is defined as the top stroke control valve switch, valve switch 193 is the flare control valve switch and valve switch 194 is the bottom stroke valve switch. The valve switches are so constructed that when not actuated by selector valve switch 201, they do not allow the passage of the fluid media through the valve switches. The valve switches 192, 193 and 194 are carried on a plate 196 and are vertically positionable thereon. To this purpose, each valve switch is provided with a threaded bore (not shown) which receives a threaded stud. Thus, valve switch 192 includes the threaded stud 197. The threaded studs are arranged to extend through associated slots forward on the plate 196. Knurled locking knobs 192A, 193A and 194A serve to lock the valve switches in an adjusted vertical position on the plate 196. The vertical position of the valve switches controls the distance that the torch head 141 is allowed to travel. In a heat cycle of operation, the valve switches 192 and 194 are controlling and are inserted into the circuit by selective actuation of a selector valve switch 201 located on a control box 203 which is located just below the plate 196. The selector valve switch 201 is positionable in a heating cycle position H or a flare position F. With the selector switch 201 rotated to the F flare position, the valve switch 192 has no effect in the circuit and the valve switch 193 is operatively connected into the circuit.

Figure 6:
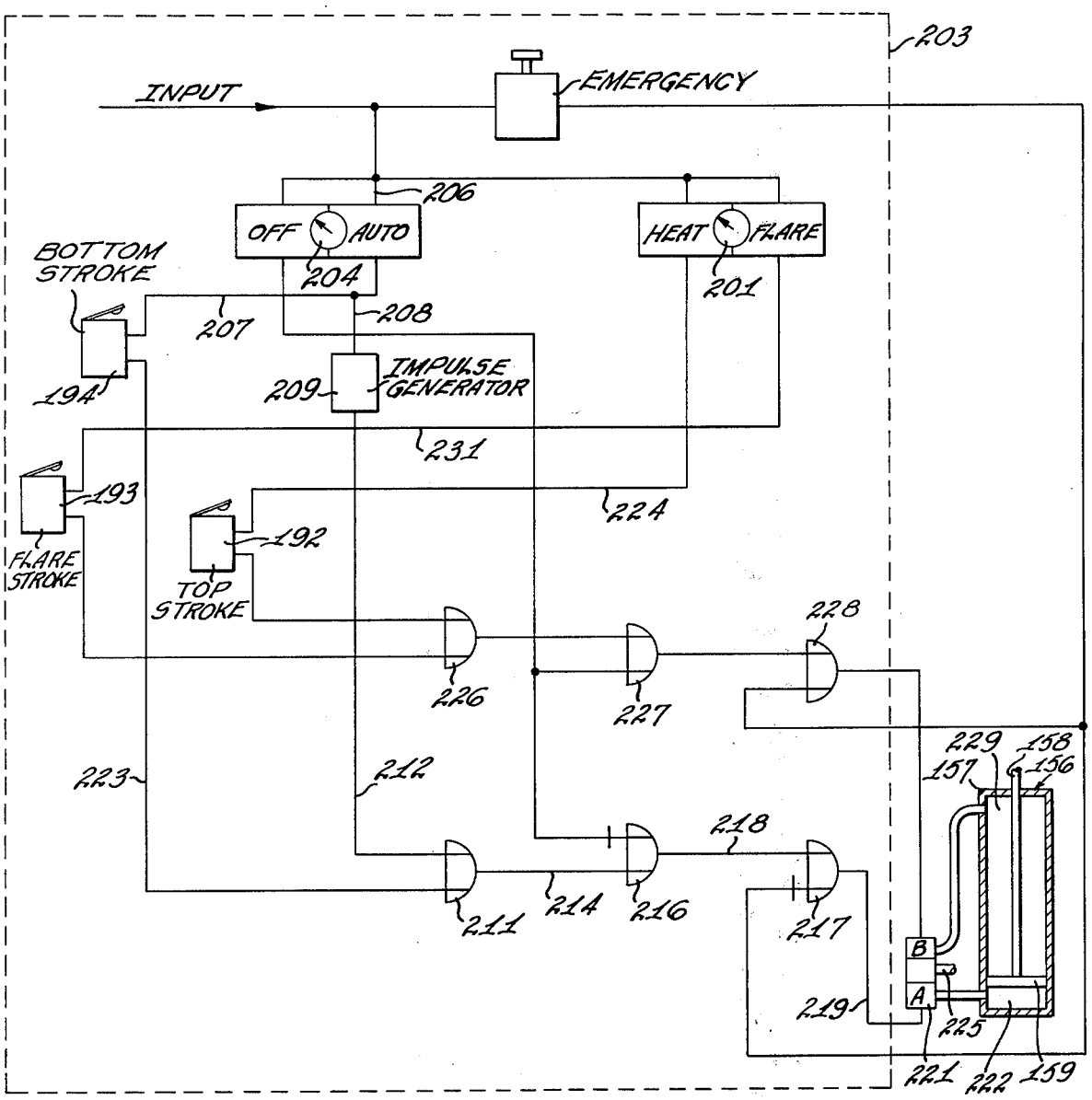

Actuation of the valve switches 192, 193 and 194 is accomplished by means of a single horizontal bar 200 which is attached to the two parallel running drive chains, one of the chains 162 being shown in FIG. 5. Thus, assuming that the torch head 142 is in the bottom position as depicted, the fluid actuator 156 will be conditioned so that the associated piston 159 is at the lower end of the cylinder 157 and the piston rod 158 retracted. With this condition obtained, the valve switch actuating bar 200 will be positioned above the actuating plunger of the valve switch 194, as depicted in FIG. 5. Thus, all the valve switches 192, 193 and 194 are closed preventing passage of fluid through them. This condition is assumed in the description of the schematic showing of the control circuit that is depicted in FIG. 6.

The control circuit is an air circuit, but a hydraulic or electrical circuit could be utilized. As shown, to place the apparatus in operation, a selector valve switch 204 is moved from "off" to "auto" position. This directs air from a source through the valve 104 via a conduit 206. The air passes through the valve switch 204 and via conduits 207 and 208 to the bottom of stroke valve switch 194 and to an impulse generator 209. The impulse generator 209 at initial startup directs a pulse of fluid to a fluidic OR gate 211. The fluid passes through the OR gate 211 via line 212 and into a connected line 214 which communicates with a fluidic NOT gate 216. The NOT gate 216 passes the fluid under pressure from the line 214 to another fluid NOT gate 217 via a line 218. The fluid under pressure from the line 218 to the NOT gate 217 passes through the gate and is directed via connecting line 219 to the A side of a distribution valve 221 to bias the valve to A side open allowing fluid under pressure from a constant source represented by the line 225 to flow through the valve into cylinder chamber 222 to start the piston 159 moving. As the piston starts on its upward movement, the chain 162, FIG. 5, moves in a counterclockwise direction of travel. Thus, the valve switch actuating bar 200 moves with the chain and actuates the plunger of the valve switch 194 thereby opening the valve switch. Thus, a pulse of fluid pressure from line 207 passes through the valve switch 194 into a connected line 223 and through the OR gate 211 and thence by the balance of the circuit, previously described, to the A side of the distribution valve 221. Since the distribution valve 221 has been previously conditioned to establish a flow path from the source of constant fluid pressure represented by the line 225, to the chamber 222, the pulse of fluid pressure passed through the valve switch 194 upon it being actuated by the bar 200 has no effect on the distribution valve 221 and the piston 159 continues to move upwardly.

Since the selector valve switch 201 is in the heat cycle, the fluid under pressure flowing through the valve switch into a line 224 is blocked by the valve switch 192. When the torch head 142 has reached a maximum upward travel as established by the position of the valve switch 192, the bar 200 will be moved into engagement with the plunger of the valve switch 192. As this occurs, a pulse of fluid pressure flows through the valve switch and thence through fluidic OR gates 226, 227 and 228. This momentary pulse of fluid under pressure is directed to the B side of the distribution valve to bias the valve to direct the fluid under pressure from the source 225 into the chamber 229 on the rod side of the piston. Thus, the piston 159 moves downwardly causing the torch head 142 to be moved downwardly. This alternate cycle of movement is continuous as long as the selector switch 204 is in "auto" and the mode selector switch 201 is in the "heat" mode.

In traveling between the valve switches 192 and 194, the bar 200 actuates the plunger of the valve switch 193. However, this has no effect on the circuit since the mode selector valve switch 201 is in the "heat" mode. This is true because with the mode selector valve switch 201 in the "heat" mode, fluid under pressure is not available to the valve switch 193. However, as soon as the operator positions the valve switch 201 into the "flare" mode, fluid under pressure is blocked to the line 224 and the valve switch 192 becomes inactive. At this time, fluid under pressure is directed into the line 231 and the flare stroke valve switch 193 is in the circuit. Thus, the cycle of the torch head movement is controlled by the position of the valve switch 194 which limits the lower limit of travel permitted to the torch head while the upper limit of travel is controlled by the physical position of the valve switch 193.

The embodiments of the invention in which an exclusive property or privilege is claimed are defined as follows:

1. An apparatus for flaring the edge of an opening formed in a cylindrical workpiece comprising:

a stationary frame having a work station;

a flaring tool in said work station engageable in the opening formed in the cylindrical workpiece;

a ram movably supported by said frame in said work station for vertical movement into and out of coupled engagement with said flaring tool;

power means operable to effect coupling engagement of said ram with said flaring tool and to forcefully engage the flaring tool with the edge of the opening in the cylindrical workpiece to form a circular collar portion around the opening;

clamping means carried by said frame for securing the workpiece in the work station;

heat applying means carried for movement into a position to heat an area of the cylindrical workpiece adjacent the opening to be flared to a plastic state;

a second heat applying means operably disposed to apply heat to the cylindrical workpiece on a side thereof which is diametrically opposite to the side which said first heating means applies its heat; and, control means operably connected to effect a predetermined movement of the heat applying means in a path of travel which is parallel to the contour of the cylindrical workpiece from a point of rest to a point short of a vertical plane which passes through the longitudinal axis of the cylindrical workpiece.

2. An apparatus for flaring the edge of an opening formed in a cylindrical workpiece comprising:

a stationary frame having a work station;

a flaring tool in said work station engageable in the opening formed in the cylindrical workpiece;

a ram movably supported by said frame in said work station for vertical movement into and out of coupled engagement with said flaring tool;

power means operable to effect coupling engagement of said ram with said flaring tool and to forcefully engage the flaring tool with the edge of the opening in the cylindrical workpiece to form a circular collar portion around the opening;

clamping means carried by said frame for securing the workpiece in the work station;

heat applying means carried for movement into a position to heat an area of the cylindrical workpiece adjacent the opening to be flared to a plastic state;

control means operably connected to effect a predetermined movement of the heat applying means in a path of travel which is parallel to the contour of the cylindrical workpiece from a point of rest to a point short of a vertical plane which passes through the longitudinal axis of the cylindrical workpiece; and, means operably connected to selectively modify the operation of said control means to establish a path of travel in a first mode and a path of travel in a second mode;

where said first mode is utilized in a heating cycle and said path of travel of said second mode is shorter in length than the path of travel of said first mode and is utilized during the engagement of the flaring tool with the edge of the opening to thereby maintain the body of the cylindrical workpiece adjacent the opening in a plastic state during the flaring operation.

3. An apparatus for flaring the edge of an opening formed in a cylindrical workpiece comprising:

a stationary frame having a work station;

a flaring tool in said work station engageable in the opening formed in the cylindrical workpiece;

a ram movably supported by said frame in said work station for vertical movement into and out of coupled engagement with said flaring tool;

power means operable to effect coupling engagement of said ram with said flaring tool and to forcefully engage the flaring tool with the edge of the opening in the cylindrical workpiece to form a circular collar portion around the opening;

clamping means carried by said frame for securing the workpiece in the work station;

heat applying means carried for movement into a position to heat an area of the cylindrical workpiece adjacent the opening to be flared to a plastic state;

a bridge movably supported by said frame for vertical movement;

supports for said clamping means carried by said bridge;

actuating means carried by said frame and operably connected to effect movement of said bridge selectively in a first direction to engage the clamping means with a cylindrical workpiece in the work station or in a second direction to disengage said clamping means from the workpiece;

means movable carrying said supports for positioning movement along said bridge; and, locking means to secure said supports to said bridge in selected adjusted position.

* * * * *